US011032636B2

(12) United States Patent
Chen et al.

(10) Patent No.: US 11,032,636 B2
(45) Date of Patent: Jun. 8, 2021

(54) SPEAKER MODULE

(71) Applicant: AAC Technologies Pte. Ltd., Singapore (SG)

(72) Inventors: Zhichen Chen, Shenzhen (CN); Wei Wei, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/525,582

(22) Filed: Jul. 30, 2019

(65) Prior Publication Data

US 2020/0045409 A1 Feb. 6, 2020

(30) Foreign Application Priority Data

Aug. 3, 2018 (CN) ..... 201810876526.4

(51) Int. Cl.
*H04R 1/28* (2006.01)

(52) U.S. Cl.
CPC ..... *H04R 1/288* (2013.01)

(58) Field of Classification Search
CPC ..... H04R 1/288; H04R 9/02; H04R 2499/11; H04R 9/06; H04R 2400/11
See application file for complete search history.

(56) References Cited

U.S. PATENT DOCUMENTS

2016/0345090 A1* 11/2016 Wilk ..... H04R 1/288
2018/0132035 A1* 5/2018 Cao ..... H04R 1/02

* cited by examiner

*Primary Examiner* — Brian Ensey
(74) *Attorney, Agent, or Firm* — W&G Law Group LLP

(57) ABSTRACT

A speaker module includes a housing and a speaker unit accommodated in the housing. The housing includes a bottom wall, a top wall, and a side wall. The speaker module further includes at least one first isolating member connected to the bottom wall and the top wall respectively. The first isolating member isolates an accommodating space into an accommodating cavity and a first filling cavity. The first isolating member includes a first metal frame and an air-permeable isolating mesh attached to the first metal frame. The first metal frame includes a first top border and a first bottom border. The first top border and/or the first bottom border is provided with a protrusion portion, and the protrusion portion abuts against the top wall or the bottom wall and is connected to the top wall or the bottom wall by spot welding.

10 Claims, 3 Drawing Sheets

SPEAKER MODULE

TECHNICAL FIELD

The present disclosure relates to electroacoustic conversion technology, and in particular, to a speaker module.

BACKGROUND

With an advent of a mobile Internet era, a time for updating electronic products becomes shorter and shorter, and requirements on performance of electronic products in various aspects are becoming higher and higher, for example, on high-quality music function. Therefore, the performance of electroacoustic systems needs to be continuously improved. Thus, a high-quality speaker module is one of essential conditions for a high-quality music function.

A DBASS polymer nano-amplification technology based on excellent sound effect thereof has been widely used in various electronic products. Currently, during a process of manufacturing a speaker module using a DBASS process, DBASS polymer nano-powder is generally filled into a specific area of a housing firstly, and a mesh is disposed to block the filling polymer nano-powder, and then a speaker unit is installed. However, as a shape of the injection area is limited by different installation environments, amount of polymer nano-powder to be filled cannot be ensured, thereby affecting sound amplification effect of products.

Therefore, it is necessary to provide a new speaker module to resolve the above problems.

DETAILED DESCRIPTION

The present disclosure will be further described with reference to the accompanying drawings.

Figure 1:
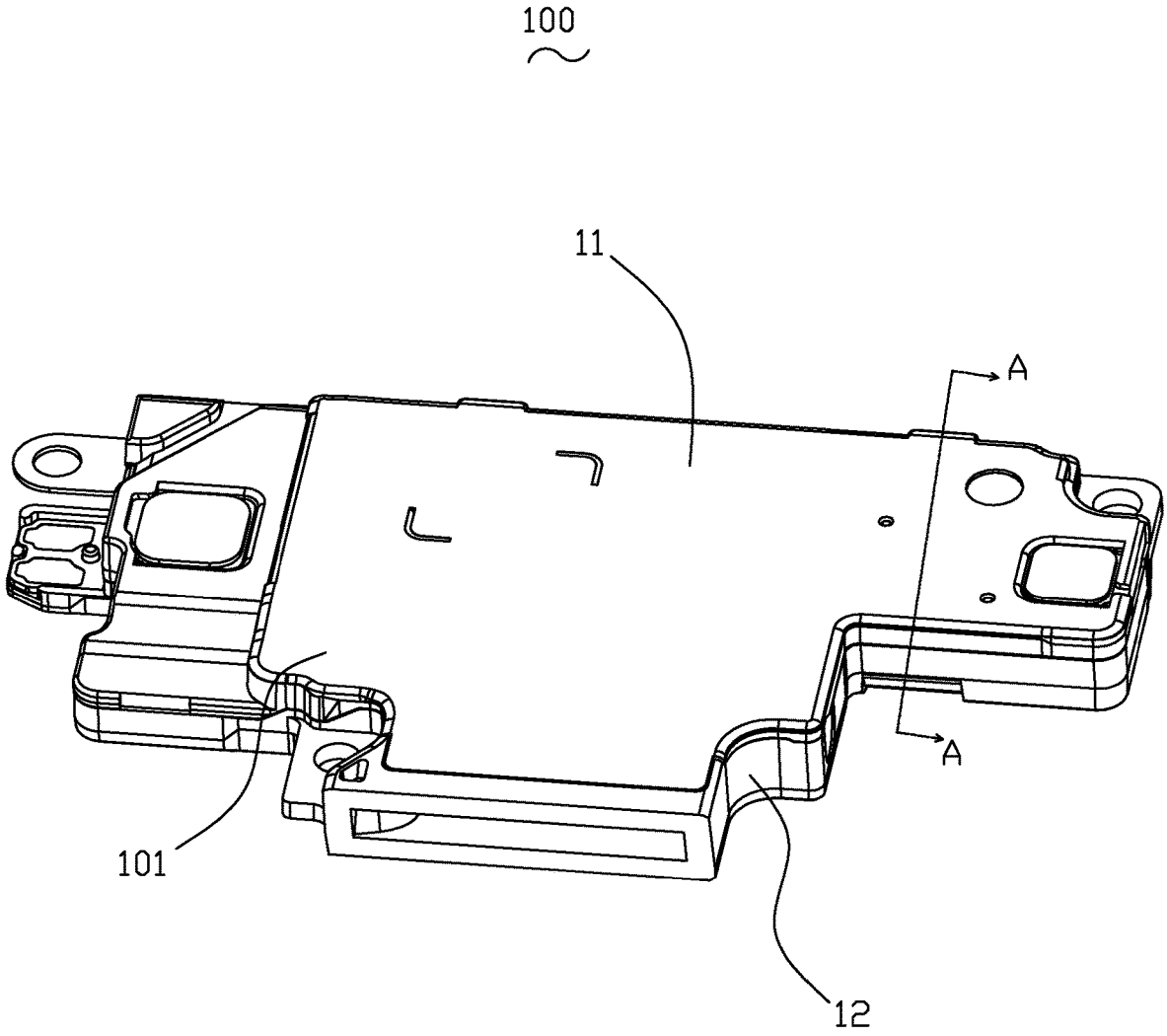
FIG. 1 is a perspective view of a speaker module of the present disclosure.
Figure 2:
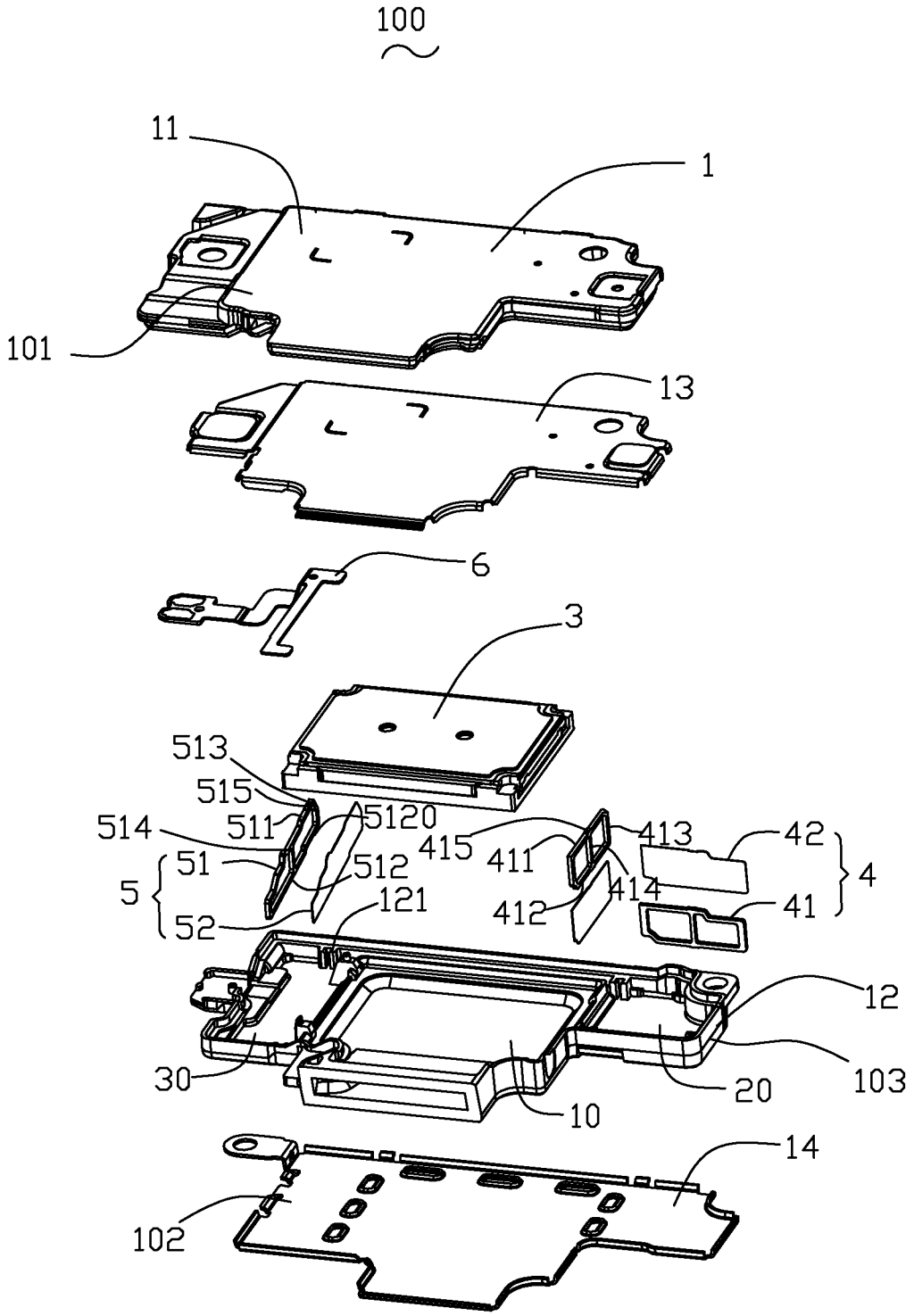
FIG. 2 is an exploded view of a speaker module of the present disclosure.

As shown in FIG. 1 and FIG. 2, the present disclosure provides a speaker module 100 which includes a housing 1 having an accommodating space and a speaker unit 3 accommodated in the housing 1.

The housing 1 includes an upper housing 11 having a top wall 101 and a lower housing 12 having a bottom wall 102. At least one of the upper housing 11 and the lower housing 12 have a side wall 103 extending in a bending manner. The side wall 103, the top wall 101, and the bottom wall 102 define the accommodating space together. The side walls 103 may be in regular shapes parallel to each other, or may be irregular structures.

The accommodating space includes an accommodating cavity 10 for accommodating the speaker unit 3, and a first filling cavity 20 and a second filling cavity 30 for accommodating a filling material. The first filling cavity 20 and the second filling cavity 30 are disposed at either side of the speaker unit 3 respectively, and the accommodating cavity and the two filling cavities are disposed opposite to and separately from each other. The filling material in the first filling cavity 20 and the second filling cavity 30 are both sound-absorbing materials. Specifically, powder filling is used in the present disclosure, and the first filling cavity 20 and the second filling cavity 30 are filled with sound-absorbing polymer particles. The first filling cavity 20 and the second filling cavity 30 are located at either side of the accommodating cavity 10 respectively.

The speaker module is further provided with an isolating member. Specifically, the isolating member includes a first isolating member 4 isolating the accommodating cavity 10 from the first filling cavity 20 and a second isolating member 5 isolating the accommodating cavity 10 from the second filling cavity 30.

There are two first isolating members 4 disposed perpendicular to each other. The two first isolating members 4, the top wall 101, the bottom wall 102, and the side wall 103 define the first filling cavity 20 together. Correspondingly, the second isolating member 5, the top wall 101, the bottom wall 102, and the side wall 103 define the second filling cavity 30 together.

The first isolating member 4 includes a first metal frame 41 and an air-permeable isolating mesh 42 attached to the first metal frame 41. The first metal frame 41 includes a first top border 411 adjacent to the top wall 101, a first bottom border 412 adjacent to the bottom wall 102, a first side border 413 and a first middle border 414 that connect the first top border 411 and the first bottom border 412. An outer edge of the air-permeable isolating mesh extends beyond an outer edge of the isolating frame, and the air-permeable isolating mesh can reduce a risk of powder leakage and has buffering, sealing and damping functions.

Figure 3:
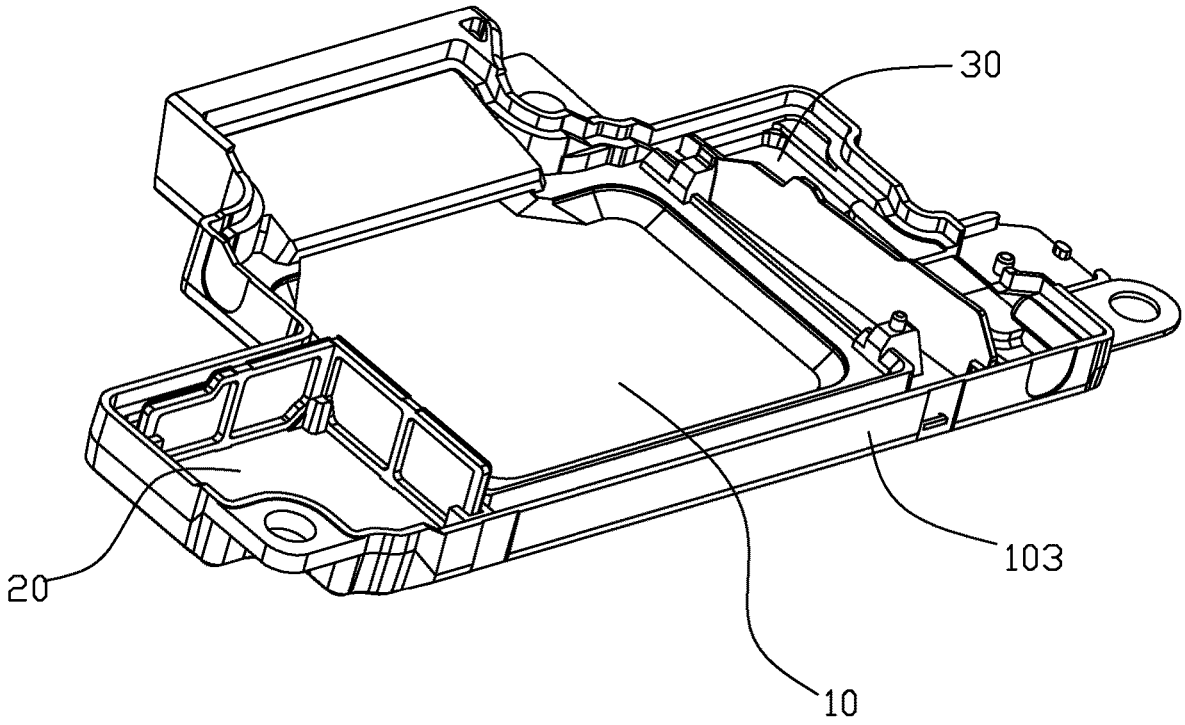
FIG. 3 is a partial schematic assembled view of a speaker module of the present disclosure.
Figure 4:
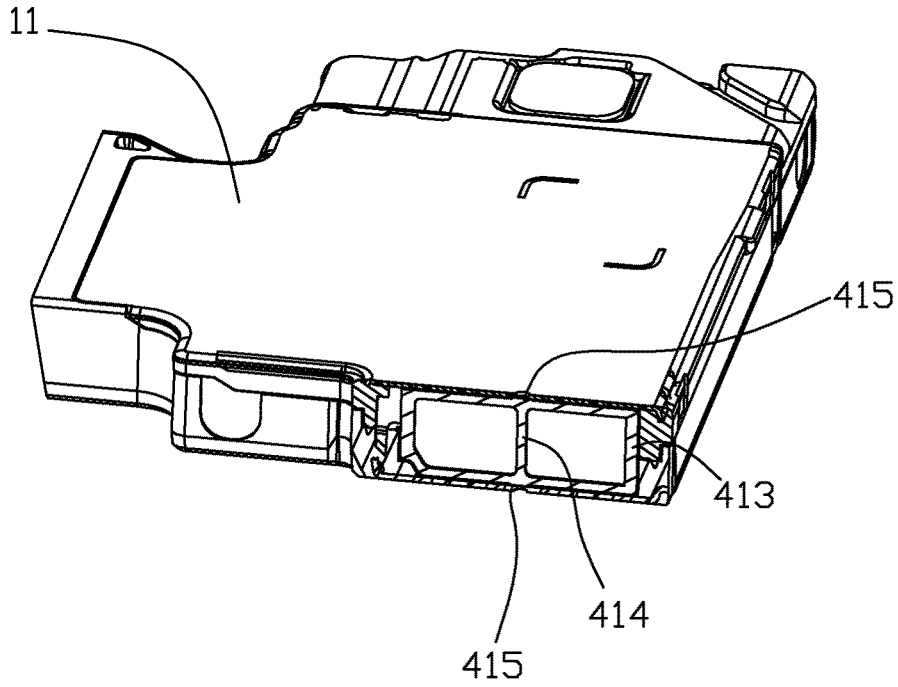
FIG. 4 is a cross-sectional view along an A-A line shown in FIG. 1.

As shown in FIG. 3 and FIG. 4, protrusion portions 415 are disposed at connected positions between the first top border 411 and the first middle border 414 and between the first bottom border 412 and the first middle border 414 respectively. The protrusion portion 415 has a height of 0.03 mm to 0.07 mm. In this embodiment, a distance between the protrusion portion 415 and the first top border 411 or between the protrusion portion 415 and the first bottom border 412 is 0.05 mm. The protrusion portion 415 on the first top border 411 abuts against the top wall 101 and the protrusion portion 415 on the first bottom border 412 abuts against the bottom wall 102 respectively. In this embodiment, the first top border 411 and the first bottom border 412 are both provided with the protrusion portion 415. In other alternative embodiments, the first top border 411 and the first bottom border 412 may also be both provided with the protrusion portion 415.

The upper housing 11 is disposed with an upper steel plate 13 and the upper steel plate 13 and the upper housing 11 are integrally injection-molded. The lower housing 12 is disposed with a lower steel plate 14 and the lower steel plate 14 and the lower housing 12 are integrally injection molded. The protrusion portions 415 are connected to the upper steel plate 13 and the lower steel plate 14 by spot welding respectively. In an actual assembly process, the protrusion portion is welded to the steel plates injection-molded in the housing from the outside of the speaker module by laser welding, resistance welding, or in other welding methods after the speaker module is completed assembly.

Of course, this is only a preferred embodiment. In practice, the protrusion portion may be disposed only on one of the first top border 411 and the first bottom border 412, or may be disposed at any position on the first top border 411 or the first bottom border 412.

The second isolating member 5 includes a second metal frame 51 and an air-permeable isolating mesh 52 attached to the second metal frame 51. The second metal frame 51 includes a second top border 511 adjacent to the top wall 101 and a second bottom border 512 adjacent to the bottom wall 102, and a second side border and a second middle border that connect the second top border 511 and the second bottom border 512. Preferably, the second isolating member 5 may also be provided with a second protrusion portion 515, and the second protrusion portion 515 may be disposed on the second top border 511, or may be disposed on the second bottom border 512. In other alternative embodiments, the second protrusion portion 515 may be disposed on both the second top border 511 and the second bottom border 512.

In addition, the speaker module further includes a flexible printed circuit board (FPCB) for electrical connection. The flexible printed circuit board extends from the accommodating cavity 10 to the second filling cavity 30 and even extends to the outside of the speaker module. The second bottom border 512 is provided with an avoiding portion 5120 for avoiding the flexible printed circuit board.

Further, the bottom wall 102 is provided with a slot 121 protruding toward the top wall 101, and two ends of the first isolating member 4 and the second isolating member 5 are inserted into the slots respectively, to facilitate positioning the isolating member.

The above structure can isolate the accommodating cavity 10 from the first filling cavity 20 and from the second filling cavity 30, so that the first filling cavity 20 and the second filling cavity 30 can be filled up with the DBASS polymer nano-powder, which cannot affect the performance of the speaker unit, and fully utilize space.

The speaker module of the present disclosure includes a housing having an accommodating space and a speaker unit accommodated in the accommodating space. The housing includes a bottom wall, a top wall opposite to the bottom wall, and a side wall extending from the bottom wall to the top wall. The speaker module further includes at least one first isolating member connected to the bottom wall and the top wall respectively. The first isolating member isolates the accommodating space into an accommodating cavity for accommodating the speaker unit and a first filling cavity for accommodating an sound-absorbing material, and the accommodating cavity is disposed opposite to the first filling cavity and separately from the first filling cavity. The first filling cavity is filled with the sound-absorbing material. The first isolating member includes a first metal frame and an air-permeable isolating mesh attached to the first metal frame. The first metal frame includes a first top border adjacent to the top wall and a first bottom border adjacent to the bottom wall. The first top border and/or the first bottom border is provided with a protrusion portion, and the protrusion portion abuts against the top wall or the bottom wall and is connected to the top wall or the bottom wall by spot welding. With respect to the speaker module of the present disclosure, the isolating member isolates the accommodating space into at least two parts, and the filling cavity is sealed and isolated from the speaker unit, so that the filling cavity can be filled up with a filling material, thereby making full use of the space, thereby enhancing the sound amplification effect, and improving the product performance.

Although the embodiments of the present disclosure are shown and described above, it can be understood that, the foregoing embodiments are exemplary, and cannot be understood as a limitation to the present disclosure. Within a scope of the present disclosure, a person of ordinary skill in the art may make changes, modifications, replacement, and variations to the foregoing embodiments.

What is claimed is:

1. A speaker module, comprising a housing having an accommodating space and a speaker unit accommodated in the accommodating space, wherein the housing comprises a bottom wall, a top wall opposite to the bottom wall, and a side wall extending from the bottom wall to the top wall, wherein the speaker module further comprises at least one first isolating member connected to the bottom wall and the top wall respectively, and the first isolating member isolates the accommodating space into an accommodating cavity for accommodating the speaker unit and a first filling cavity for accommodating a sound-absorbing material, wherein the first isolating member comprises a first metal frame and an air-permeable isolating mesh attached to the first metal frame, wherein the first metal frame comprises a first top border adjacent to the top wall and a first bottom border adjacent to the bottom wall, the first top border and/or the first bottom border is provided with a protrusion portion, and the protrusion portion abuts against the top wall or the bottom wall and is connected to the top wall or the bottom wall by spot welding.

2. The speaker module according to claim 1, wherein the housing comprises a lower housing having the bottom wall and an upper housing having the top wall, wherein the upper housing is disposed with an upper steel plate and the upper steel plate and the upper housing are integrally injection-molded, the lower housing is disposed with a lower steel plate and the lower steel plate and the lower housing are integrally injection-molded, and the protrusion portion is connected to the upper steel plate and/or the lower steel plate by spot welding.

3. The speaker module according to claim 2, wherein the first top border and the first bottom border are both provided with a protrusion portion, and the protrusion portions are connected to the upper steel plate and the lower steel plate by spot welding respectively.

4. The speaker module according to claim 1, wherein the first metal frame further comprises a first side border and a first middle border that connect the first top border and the first bottom border, and the protrusion portion is disposed opposite to the first middle border.

5. The speaker module according to claim 1, wherein the first filling cavity is disposed at one side of the speaker unit, and the speaker module further comprises a second filling cavity disposed at the other side of the speaker unit to be filled with a sound-absorbing material, and a second isolating member isolating the accommodating cavity from the second filling cavity.

6. The speaker module according to claim 5, wherein the second isolating member comprises a second metal frame and an air-permeable isolating mesh attached to the second metal frame, wherein the second metal frame comprises a second top border adjacent to the top wall and a second bottom border adjacent to the bottom wall, the second top border and/or the second bottom border is provided with a second protrusion portion, and the second protrusion portion abuts against the top wall or the bottom wall and is connected to the top wall or the bottom wall by spot welding.

7. The speaker module according to claim 6, wherein the speaker module comprises a flexible printed circuit board electrically connected to the speaker unit, and the second bottom border is provided with an avoiding portion for avoiding the flexible printed circuit.

8. The speaker module according to claim 1, wherein there are two first isolating members, and the two first isolating members, the top wall, the bottom wall, and the side wall define the first filling cavity together.

9. The speaker module according to claim 1, wherein the bottom wall is provided with a slot protruding toward the top wall, and two ends of the first isolating member are inserted into the slots respectively.

10. The speaker module according to claim 1, wherein the protrusion portion has a height of 0.03 mm to 0.07 mm.

* * * * *